US007435027B2

(12) United States Patent
Hetzel

(10) Patent No.: US 7,435,027 B2
(45) Date of Patent: Oct. 14, 2008

(54) MULTI-RESERVOIR CONTAINER WITH APPLICATOR TIP AND METHOD OF MAKING THE SAME

(75) Inventor: Marvin J. Hetzel, Lewisburg, TN (US)

(73) Assignee: Cosmolab Inc., Lewisburg, TN (US)

( * ) Notice: Subject to any disclaimer, the term of this patent is extended or adjusted under 35 U.S.C. 154(b) by 489 days.

(21) Appl. No.: 11/072,706

(22) Filed: Mar. 4, 2005

(65) Prior Publication Data

US 2006/0198686 A1 Sep. 7, 2006

(51) Int. Cl.
*A46B 11/00* (2006.01)
*B43M 11/06* (2006.01)
*B67D 5/60* (2006.01)

(52) U.S. Cl. ..... 401/47; 401/44; 401/183; 222/145.1; 222/145.5

(58) Field of Classification Search ..... 401/40–44, 401/47, 192, 183–186; 222/94, 145.1, 145.3, 222/145.5, 145.4, 145.6, 145.7, 145.8, 145.2
See application file for complete search history.

(56) References Cited

U.S. PATENT DOCUMENTS

| | | | |
|---|---|---|---|
| 608,958 | A | 8/1898 | Ferraioli |
| 1,535,529 | A | 4/1925 | Hopkins |
| 1,639,699 | A | 8/1927 | Hopkins |
| 1,698,404 | A | 1/1929 | Hopkins |
| 1,699,532 | A | 1/1929 | Hopkins |
| 1,950,137 | A | 3/1934 | Dowe |
| 2,218,092 | A | 10/1940 | Nitardy |
| 2,297,690 | A | 10/1942 | Nitardy |
| 2,939,610 | A | 6/1960 | Castelli et al. |
| 2,959,327 | A | 11/1960 | Bloom |
| 3,105,615 | A | 10/1963 | Koga |
| 3,135,428 | A | 6/1964 | Gallo, Sr. |
| 3,175,731 | A | 3/1965 | Ellman |
| 3,184,782 | A | 5/1965 | Armour |
| 3,200,995 | A | 8/1965 | Gangwisch |

(Continued)

FOREIGN PATENT DOCUMENTS

| | | | |
|---|---|---|---|
| DE | 537506 | C | 10/1931 |

(Continued)

OTHER PUBLICATIONS

International Search Report of International Application No. PCT/US05/10670 filed Jul. 7, 2005 (7 pages).

(Continued)

*Primary Examiner*—David J Walczak
(74) *Attorney, Agent, or Firm*—Marshall, Gerstein & Borun LLP

(57) ABSTRACT

A cosmetic applicator for storing and dispensing a plurality of cosmetic masses includes an applicator container and an applicator tip; and methods for making the same. The applicator container includes a first reservoir having an elongate portion that is disposed in a second reservoir having a neck portion. The applicator tip includes an outer portion and an inner portion having an inlet and an outlet that is fluidly connected by a shaft having at least one wall. The outer portion engages the neck portion and the elongate portion is disposed in the shaft thereby defining a channel that is fluidly connected to the second reservoir between the elongate portion and the at least one wall.

22 Claims, 4 Drawing Sheets

U.S. PATENT DOCUMENTS

| | | | | | |
|---|---|---|---|---|---|
| 3,217,931 | A | * | 11/1965 | Farrar et al. | 222/94 |
| 3,272,387 | A | | 9/1966 | Katz et al. | |
| 3,635,375 | A | | 1/1972 | Gaetke | |
| 3,813,011 | A | | 5/1974 | Harrison et al. | |
| 3,850,346 | A | | 11/1974 | Richardson et al. | |
| 4,022,351 | A | | 5/1977 | Wright | |
| 4,047,642 | A | | 9/1977 | Nilson | |
| 4,211,341 | A | | 7/1980 | Weyn | |
| 4,340,154 | A | | 7/1982 | VanManen | |
| 4,366,919 | A | | 1/1983 | Anderson | |
| 4,585,149 | A | | 4/1986 | Zulauf | |
| 4,687,663 | A | | 8/1987 | Schaeffer | |
| 4,849,213 | A | | 7/1989 | Schaeffer | |
| 5,033,650 | A | | 7/1991 | Colin et al. | |
| 5,076,470 | A | | 12/1991 | Hatakeyama et al. | |
| 5,102,013 | A | | 4/1992 | Schneider et al. | 222/94 |
| 5,295,613 | A | | 3/1994 | Barthomeuf et al. | |
| 5,328,056 | A | | 7/1994 | Schneider et al. | 222/94 |
| 5,497,910 | A | | 3/1996 | Meadows et al. | |
| 5,505,342 | A | | 4/1996 | Okamura et al. | |
| 5,566,860 | A | | 10/1996 | Schiltz et al. | |
| 5,615,803 | A | | 4/1997 | Hatakeyama et al. | |
| 6,026,989 | A | | 2/2000 | Richmond | |
| 6,059,570 | A | * | 5/2000 | Dragan et al. | 433/80 |
| 6,176,395 | B1 | | 1/2001 | Abbott et al. | |
| 6,223,943 | B1 | | 5/2001 | Richmond et al. | |
| 6,257,450 | B1 | | 7/2001 | Jackson et al. | 222/94 |
| 6,334,449 | B1 | | 1/2002 | Burrowes et al. | |
| 6,347,726 | B1 | | 2/2002 | Jackson et al. | 222/94 |
| 6,358,494 | B1 | | 3/2002 | Aoki et al. | |
| 6,505,986 | B1 | | 1/2003 | Oder | |
| 6,634,524 | B1 | | 10/2003 | Helmenstein | |
| 6,698,627 | B2 | | 3/2004 | Garcia et al. | |
| 2002/0185501 | A1 | | 12/2002 | Yquel | |
| 2003/0106903 | A1 | | 6/2003 | Chan et al. | |
| 2005/0029292 | A1 | | 2/2005 | Ophardt | |

FOREIGN PATENT DOCUMENTS

| | | |
|---|---|---|
| DE | 93 02 869.5-UI | 5/1993 |

OTHER PUBLICATIONS

European Search Report, dated Jul. 13, 2006, from the European Patent Office in counterpart application EP 05012599.6-2308.

* cited by examiner

MULTI-RESERVOIR CONTAINER WITH APPLICATOR TIP AND METHOD OF MAKING THE SAME

BACKGROUND

1. Field of the Disclosure

The disclosure generally relates to cosmetic applicators having a multi-reservoir container with applicator tips for containing and dispensing a plurality of cosmetic masses. More particularly, the disclosure relates to dual-reservoir containers having applicator tips for combining and dispensing two separately stored cosmetic masses.

2. Brief Description of Related Technology

Cosmetic containers for storing a plurality of fluid masses take various forms, including tubes and bottles. Similarly, the provided mechanisms in which these masses are dispensed from such containers vary greatly.

For example, U.S. Pat. No. 1,535,529 discloses a collapsible tube. The collapsible tube includes an inner collapsible container, an outer collapsible container, and a screw cap. In the embodiment in which material from both containers is combined prior to dispensing, the inner and outer collapsible containers are connected at the top of the collapsible tube which includes an outer threaded surface to engage the screw cap. The interiors of the inner and outer containers are connected via holes in the inner container. Upon engagement of the screw cap with the outer collapsible tube, a downwardly projecting member disposed on an inner surface of the screw cap travels into the inner collapsible tube thereby closing the opening to the inner collapsible container and closing the holes between the inner and outer containers.

In another example, U.S. Pat. No. 1,639,699 discloses an article of manufacture comprising a container and contents therefor. The article includes an inner collapsible tube having a neck piece and an outer collapsible tube also having a neck piece, wherein the neck piece of the inner collapsible tube is disposed within the neck piece of the outer collapsible tube. A gap formed between the neck portions allows for the dispensing of a mass from the outer collapsible tube, and an orifice in the neck portion of the inner tube allows for the concentric dispensing of a mass from the inner collapsible tube.

In yet another example, U.S. Pat. No. 1,698,404 discloses a multiple compartment collapsible tube. The collapsible tube includes an inner collapsible tube, an outer collapsible tube, and a cap. The outer collapsible tube includes a neck portion having a threaded outer surface that engages the cap. A neck portion of the inner tube is disposed within the neck portion of the outer tube. A plurality of capillaries is formed between the neck portions for dispensing a mass from the outer tube.

SUMMARY

One aspect of the disclosure provides a cosmetic applicator having an applicator container and an applicator tip for storing and dispensing a plurality of cosmetic masses. The applicator container includes a first reservoir having an elongate portion that is disposed in a second reservoir having a neck portion. The applicator tip includes an outer portion that engages the neck portion, and an inner portion having an inlet and an outlet fluidly connected, by a shaft having at least one wall, to the applicator container. The elongate portion and the at least one wall of the shaft define a channel that is fluidly connected to the second reservoir.

Another aspect of the disclosure provides a cosmetic applicator including an applicator container and an applicator tip for storing and dispensing a plurality of cosmetic masses. The applicator container includes a first transparent reservoir having a first mass disposed therein, and a second transparent reservoir having a second mass disposed therein. The first reservoir is disposed in the second reservoir, and the second mass is at least translucent. The applicator tip includes a shaft having an outlet and that is fluidly connected to the applicator container. The first and second masses are disposed together in the shaft upstream from the outlet, when the first and second masses are dispensed from the applicator container.

Another aspect of the disclosure provides a cosmetic applicator including an applicator container, an applicator tip, and a cap for storing and dispensing a plurality of cosmetic masses. The applicator container includes a first reservoir having an elongate portion and a second reservoir including a neck portion. The first reservoir is disposed within the second reservoir, and the elongate portion is disposed in a shaft. The elongate portion and the shaft define a channel that is fluidly connected to the second reservoir. The applicator tip includes an outer portion that engages an inner surface of the neck portion and an inner portion that has an inlet and an outlet that are fluidly connected by the shaft. The shaft includes one or more radially extending ribs that align the elongate portion relative to the shaft, and one or more radially extending protrusions to control a depth of engagement of the elongate portion into the shaft. The cap includes a plug that seals the elongate portion and the channel, when the cap is fully engaged on the applicator tip.

Further aspects and advantages may become apparent to those skilled in the art from a review of the following detailed description, taken in conjunction with the appended claims. While the invention is susceptible of embodiments in various forms, described hereinafter are specific embodiments with the understanding that the disclosure is illustrative, and is not intended to limit the invention to the specific embodiments described herein.

DETAILED DESCRIPTION

A multi-reservoir cosmetic applicator having an applicator tip for containing and dispensing a plurality of cosmetic masses and methods of making such reservoirs and applicator tips, are disclosed herein.

Figure 1:
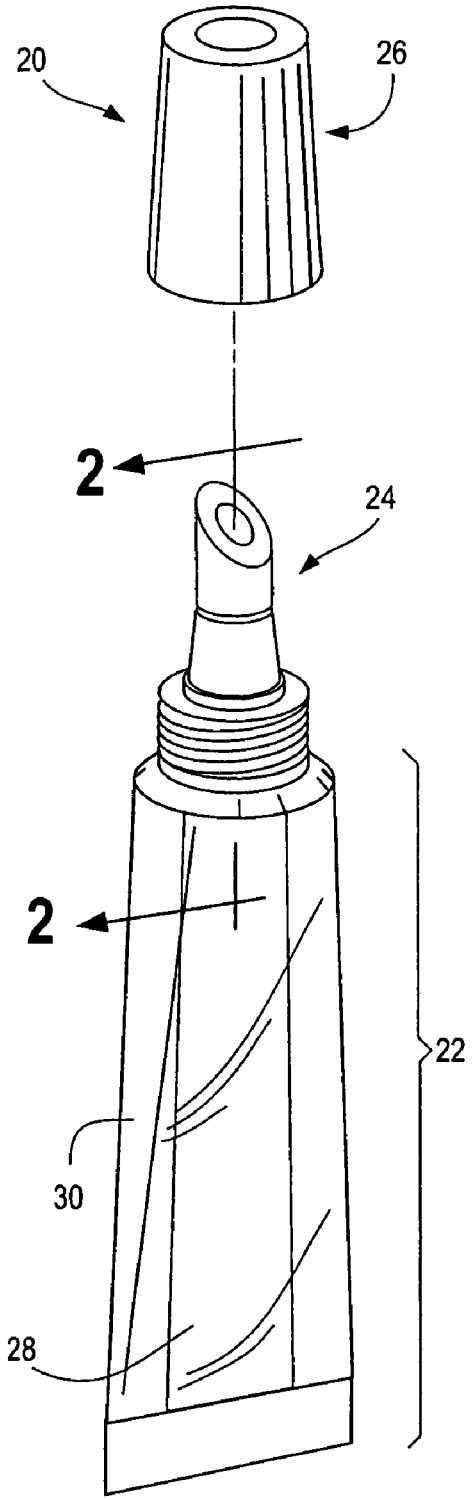
FIG. 1 is an isometric view of one embodiment of an applicator according to the disclosure, the applicator including a dual-reservoir container, a cap, and an applicator tip.
Figure 2:
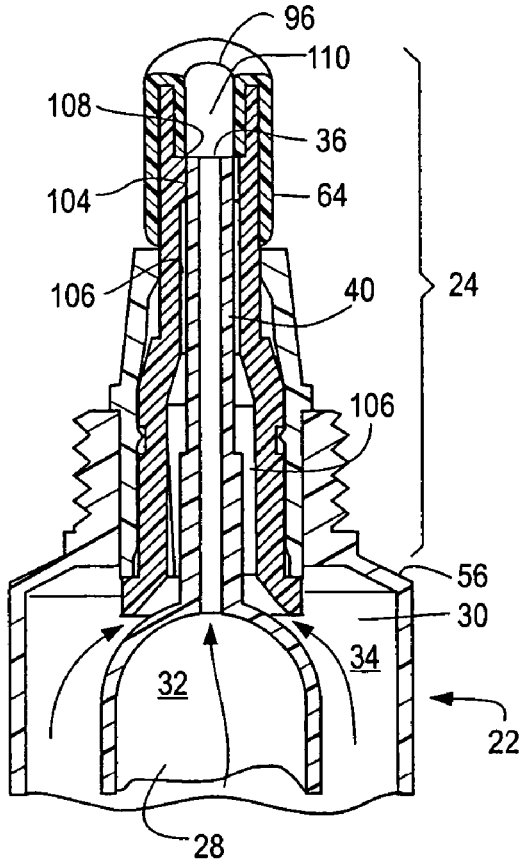
FIG. 2 is a detailed cross-sectional view of the applicator along line 2-2 of FIG. 1 without the cap.
Figure 3:
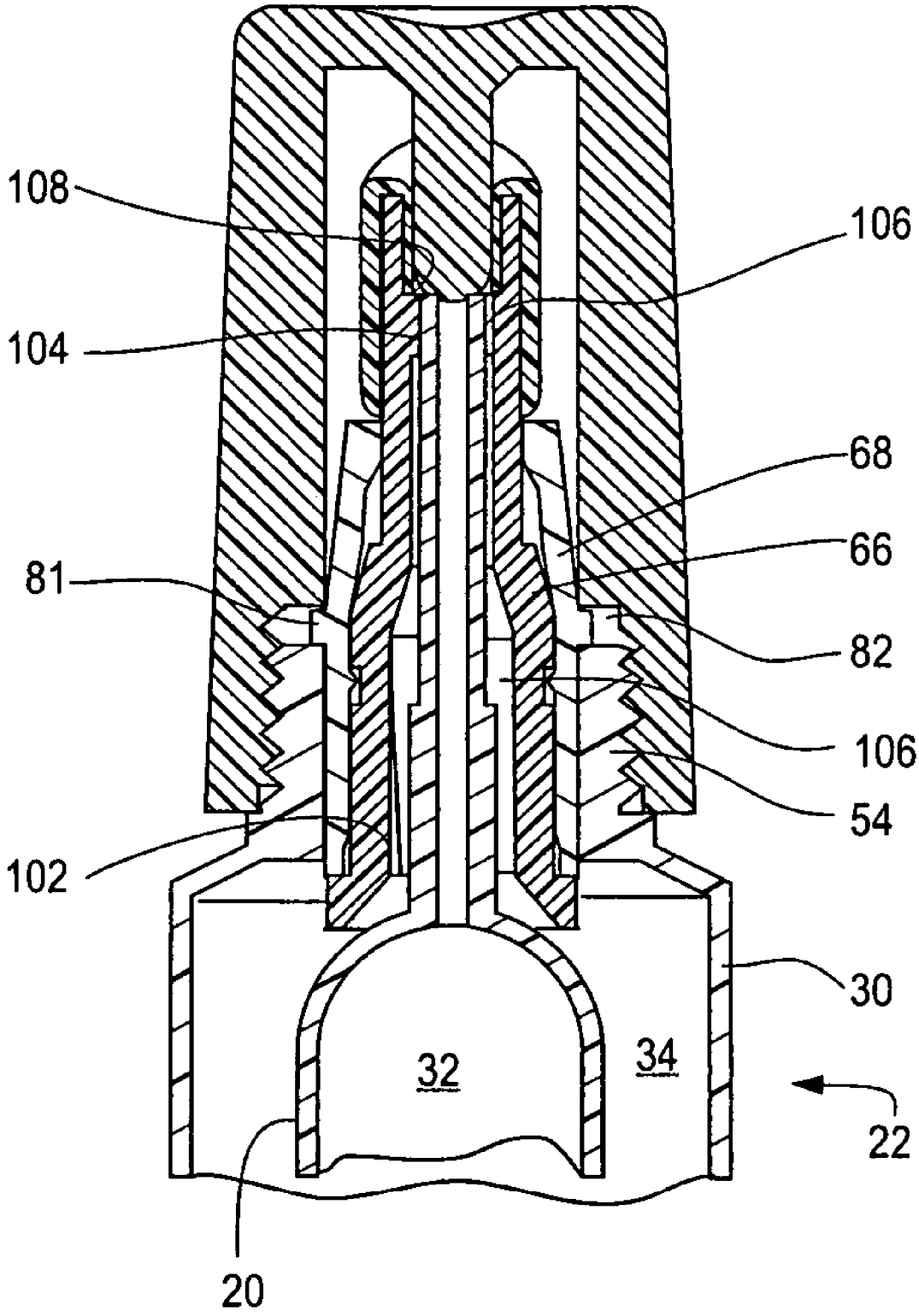
FIG. 3 is a detailed cross-sectional view of the applicator along line 2-2 of FIG. 1 with the cap.

Referring to FIG. 1, an applicator 20, includes a container 22, an applicator tip 24 (FIGS. 2-4), and a cap 26. The container 22 includes at least a first reservoir 28 for storing a first cosmetic mass 32, and a second reservoir 30 for storing a second cosmetic mass 34 (FIG. 2). As illustrated in FIGS. 2 and 3, the container 22 is fluidly connected to the applicator tip 24, such that upon compression, activation or manipulation of the container 22, the first and second masses 32, 34 are dispensed from the applicator 20.

More specifically, as illustrated in FIG. 2, the first and second masses 32, 34 are stored in separate reservoirs 28, 30, such that no contact between the bulk masses 32, 34 exists. Preferably the first and second masses 32, 34 first combine in the applicator tip 24 prior to exiting the applicator 20.

The container 22 (FIG. 5), including the reservoirs 28, 30, can be made of any suitable material compatible with the cosmetic masses 32, 34. Each of the reservoirs 28, 30, can be made of the same materials or different materials. Preferred materials for the container 22 are pliable, especially elastically-deformable materials such that the container 22 tends to spring back to its original shape, to provide a fine degree of regulation to the flow of the cosmetic masses on demand by the user's hand. In the alternative, inelastically-deformable materials, such as metal foils, can be used. Suitable materials include, but are not limited to, polypropylene, high density polyethylenes (HDPE), low density polyethylenes (LDPE), ethylene vinyl alcohol (EVOH) polymers or oligomers thereof. The materials may further include additives such as, for example, plasticizers, heat stabilizers, slip agents (e.g., lubricants for extrusion and mold release agents), odor masking agents, ultraviolet light barriers, pigments, dyes, waxes, nucleating agents (e.g., to improve rate of crystallization).

The container 22 may also be constructed using mono or multi layer technology. For example, the container 22 may be constructed from one or more layers of material, such as the ones listed above. These layers may be connected or separated using a barrier layer or adhesive resin layer, such as for example, a layer of ADMER modified polyolefin adhesive resin. In one exemplary embodiment, the container 22 is constructed from a five layer process wherein the layers are, beginning from the outside, LDPE, ADMER, EVOH, ADMER, and LDPE.

The container 22 may be constructed from an at least translucent material or include a region that is at least translucent (e.g., a window), such that one or both of the cosmetic masses 32, 34 are viewable by the user. Alternatively, one or both of the reservoir 28 and the reservoir 30 may be constructed from an opaque material. In a preferred embodiment, at least the reservoir 30 is translucent or transparent. The terms "transparent" and "translucent" as used herein, unless otherwise specified, are intended to connote their usual dictionary definitions. Thus, a transparent substance, like glass, allows ready viewing of objects behind the substance. A translucent substance allows light to pass through, but causes the light to be so scattered that it is difficult or impossible to clearly identify objects behind the translucent substance.

The container 22 can be made by various processes, including the use of an extrusion process and an injection molding process. For example, a reservoir material can be formed into a cylinder (e.g., by extrusion), and sealed at one end (e.g., by heating and crimping) to form a tubular reservoir. Such a container tube can be spin-welded, ultrasonic welded, or otherwise bonded to a neck, preferably before sealing. In another method, an applicator tip/reservoir combination can be injection molded as a single piece. Any other suitable fabrication method is contemplated for use.

The applicator tip 24 and cap 26 (FIGS. 3 and 4) can also be made of any suitable material compatible with the cosmetic masses, and is preferably more rigid than the container 22. For example, as described above, the applicator tip 24 and the cap 26 can be constructed from any of the above materials, including nylon 6.6 and hytrel, and by any of the above processes.

The cosmetic masses 32, 34 may include any conceivable fluid or pasty mass, including water based, oil based and alcohol based products, and combinations of the foregoing including emulsions, colloids, and suspensions. The masses may be translucent, opaque, and may be of any color. Similarly, the masses may include glitter, or other particles. As a result, the applicator 20 and the cosmetic masses may be used for lip-gloss, cleansers, suntan lotion, acne, concealers, and may be used with many other products, for many applications.

Figure 4:
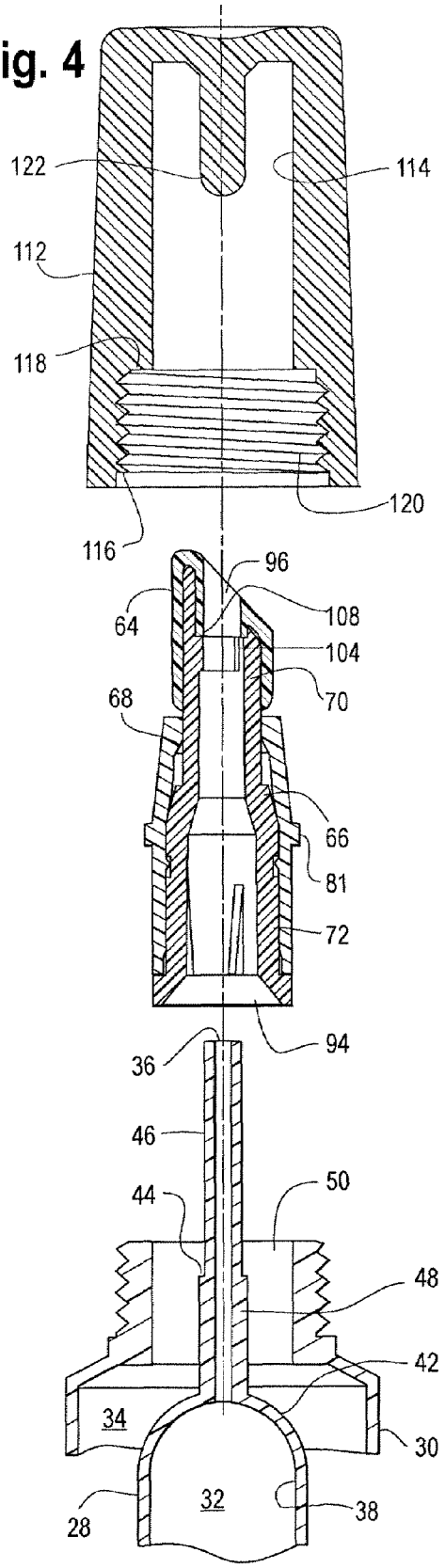
FIG. 4 is an exploded cross-sectional view of FIG. 3.
Figure 5:
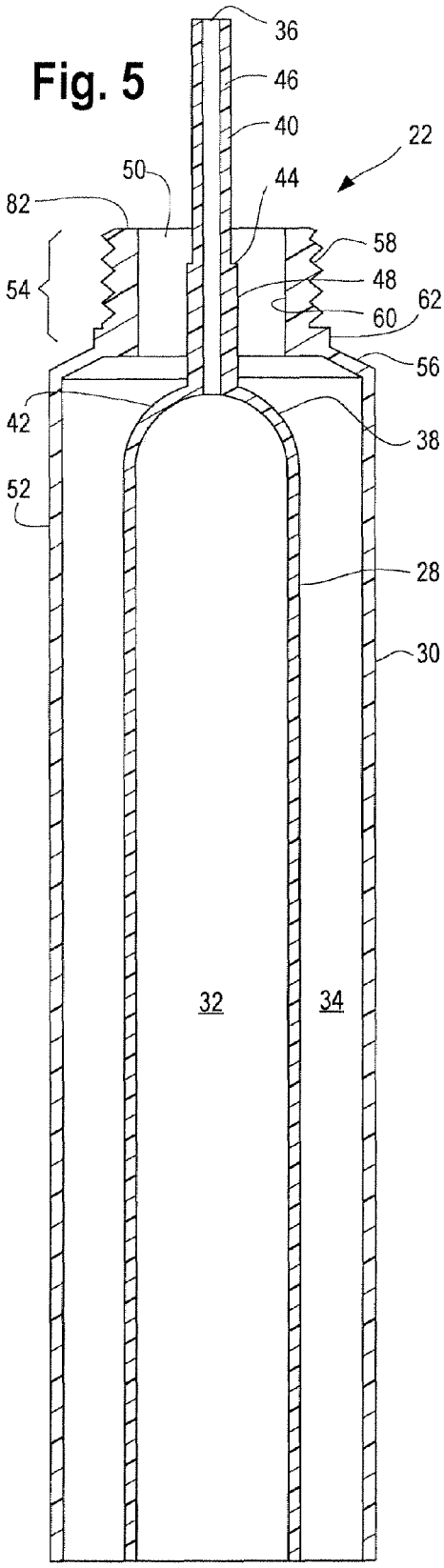
FIG. 5 is a cross-sectional view of the container of FIG. 1.

In one exemplary embodiment, as seen in FIGS. 4-5, the first or inner reservoir 28 may be disposed within the outer or second reservoir 30. The inner reservoir 28 includes an opening 36 disposed near a first end 38 of the inner reservoir 28 for receiving and/or dispensing the first cosmetic mass 32, and is crimped or otherwise sealed at the other end. The inner reservoir 28 includes an elongate portion or pipette 40 that extends from the first end 38 of the inner reservoir 28. As a result, the opening 36 is disposed at the distal end of the elongate portion 40. A shoulder portion 42 is disposed between and connects the elongate portion 40 to the main body of the inner reservoir 28. The elongate portion 40 may include a stepped portion having a step 44 disposed between a first and a second section 46, 48 of the elongate portion 40. The second section 48 extends from the shoulder portion 42 and is larger in diameter than the first section 46.

The outer reservoir 30 includes an opening 50 disposed near a first end 52 of the outer reservoir 30 for receiving the applicator tip 24 and is crimped or otherwise sealed at the other end. The opening 50, as best seen in FIG. 5, may be disposed at the end of a neck portion 54 of the outer reservoir 30 that extends from a shoulder portion 56 disposed between the neck portion 54 and the main body of the outer reservoir 30. The neck portion 54 may have a generally cylindrical shape and may include an outer surface 58 having threads for engaging the cap 26, and an inner surface 60 for receiving the applicator tip 24. Additionally, a stepped portion 62 disposed between a shoulder 56 and the threaded portion may provide a mating surface for sealing to the cap 26.

Figure 6:
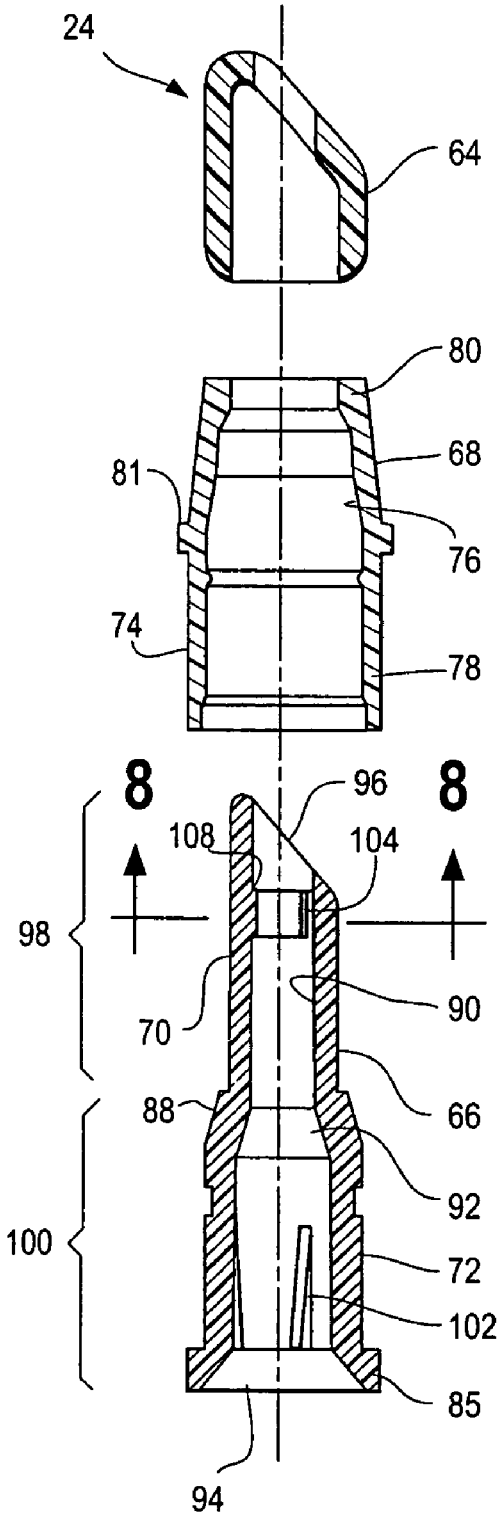
FIG. 6 is an exploded cross-sectional view of the applicator tip of FIG. 4.

The applicator tip 24, as illustrated in FIGS. 4 and 6, is fluidly and sealingly connected to the container 22 and combines and dispenses the cosmetic masses 32, 34 contained therein. The embodiment of the applicator tip 24 shown includes a head 64, a body 66, and a sleeve 68, wherein the head 64 is disposed near a first end 70 of the body 66, and the sleeve 68 is disposed near a second end 72 of the body 66. Alternatively, the sleeve 68 and the body 66 may be constructed as a single piece depending on the manufacturability of the applicator tip 24 and other factors, such as cost considerations, for example.

As such, the applicator tip 24 may be interchanged or replaced on the container 22 with other similar configured applicator tips. For example, the applicator tip 24 may be replaced with another applicator tips having a different flow rate or a different head configuration. This interchange or replacement may occur during use or manufacture of the applicator 20.

The sleeve 68, as illustrated in FIG. 6, has a generally tubular shape including an outer surface 74 and an inner surface 76 that defines a cavity that is reduced in size from a second end 78 to a first end 80 of the sleeve 68. The sleeve 68 is disposed between and connects the body 66 to the container 22 and, more specifically, to the neck 54 of the outer reservoir 30 (FIG. 3). A ring 81 extends radially outward from the outer surface 74 of the sleeve 68 and abuts a top 82 of the neck 54, such that the sleeve 68 and/or the applicator tip 24 is prevented from further insertion into the container 22. The sleeve 68 and the body 66 may be engaged by inserting the first end 70 of the body 66 into the second end 78 of the sleeve 68 and continuing that relative engagement until the sleeve 68 and the body 66 are fully engaged and/or the body 66 and the sleeve 68 snap into each other. For example, as best seen in FIG. 4, the first end 70 of the body 66 may bottom-out against the reduced cavity at the first end 80 of the sleeve 68, and/or the second end 78 of the sleeve 68 may abut a flange 85 at the second end 72 of the body 66.

The body 66 includes an outer surface 88 that engages the sleeve 68 at a proximal end of the applicator tip 24, and that engages the applicator head 64 at a distal end of the applicator tip 24. The body 66 further includes an inner surface 90 that defines a shaft 92 extending from an inlet 94 to an outlet 96 of the applicator tip 24. The shaft 92 may include a first section 98 adjacent the outlet 96 having a smaller diameter than a second section 100 adjacent the inlet 94, such that upon engagement of the elongate portion 40 with the applicator tip 24, the first and second section 46, 48 of the elongate portion 40 correspond to or coincide with the first and second sections 98, 100, respectively of the shaft 92.

Figure 7:
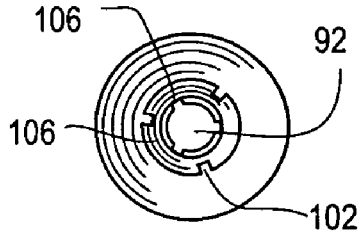
FIG. 7 is a bottom view of the applicator tip of FIG. 6.
Figure 8:
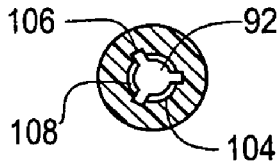
FIG. 8 is a cross-sectional along line 8-8 of FIG. 6.

The shaft 92 and, more specifically, the first section 98 of the shaft 92, may include features such as a first set of ribs 104 extending from the inner surface 90 of the shaft 92 (FIGS. 6 and 7). Ends of the first set of ribs 104 define an area for receiving and holding the elongate portion 40 and, more specifically, for receiving and holding the first section 46 of the elongate portion 40. Similarly, the second section 100 of the shaft 92, may include a second set of ribs 102 extending from the inner surface 90 of the shaft 92. Ends of the second set of ribs 102 may also define an area for receiving and holding the elongate portion 40 and, more specifically, for receiving and holding the second section 48 of the elongate portion 40. In an alternative embodiment, for example, the elongate portion 40 may include one or more features such as ribs instead of the shaft 92, for the same purposes.

One or more grooves are created between the ribs of both the first and the second set of ribs 102, 104. As a result, when the applicator tip 24 and the elongate portion 40 are engaged, one or more channels 106 defined by the inner surface 90 of the applicator tip 24, the elongate portion 40, and the ribs 102, 104, are created for fluidly connecting the outer reservoir 30 to the outlet 96 (FIGS. 3, 4 and 6).

The first set of ribs 104 may further include features such as stop members or protrusions 108 extending inwardly toward a center of the shaft 92, such that the distal end of the elongate portion 40 abuts the stop members 108 during engagement, thereby preventing the elongate portion 40 from further insertion into the shaft 92. The stop members 108 and/or the distal end of the elongate portion 40, once inserted into the applicator tip 24, are disposed short of the distal end of the applicator tip 24 in the shaft 92, such that a combining (e.g., mixing) area 110 defined between the distal end of the applicator tip 24 and the distal end of the elongate portion 40 and/or the stop members 108 remains (FIG. 2). The combining area 110 and/or the entrance thereto may include one or more static or dynamic elements to promote mixing.

The head 64, as illustrated in FIGS. 4 and 6, of the applicator 20 may be a wholly separate piece or unit from the body 66 that may be removably or fixedly attached to the distal end of the body 66, or may be integral to the body 66. The head 64 may include on or more features for functions including, but not limited to, spreading, applying, shaping, blending, and in some embodiments, removing the cosmetic mass. The head 64 may include various shapes, sizes, textures, and materials of construction, depending on the intended use of the applicator 20. For example, the head 64 may include, brushes, sponges, puffs, swabs, etc., and may have a straight, angled, or doe foot configuration. In one exemplary embodiment, the head 64 may be integrally formed with the distal end of the body 66, and may include a plurality of fibers (e.g., bristles or flocking) to aid in applying the cosmetic masses 32, 34.

In the embodiment of the applicator tip 24 wherein the head 64 is not integral to the body 66, the head 64 may be interchanged or replaced on the body 66 with other heads. This interchange or replacement may occur during use or manufacture of the applicator 20.

The cap 26, as illustrated in FIG. 4, includes an outer surface 112, an inner portion including an inner surface 114 that defines a cavity for receiving at least a portion of the applicator tip 24, first and second ledges 116 and 118, a threaded portion 120, and a pentel or plug 122. In the embodiment shown, the pentel 122 has a generally cylindrical shape including a semi-spherical end and extends from the inner surface 114 near a top portion of the cap 26. The pentel 122 may be sized and shaped to slidingly engage the outlet 96 of the applicator tip 24, and may be of sufficient length to abut the distal end of the elongate portion 40. The threaded portion 120 is disposed near a bottom of the cap 26 and engages a threaded portion on the container 22 and, more specifically, engages the threaded portion on the neck 54 of the outer reservoir 30. The first ledge 116 is disposed adjacent the threaded portion 120 towards the bottom of the cap 26, and may engage the stepped portion 62 on the container 22 when the cap 26 fully engages the container 22. The second ledge 118 is also disposed adjacent the treaded portion 120 but towards the top of the cap 26, and may engage the ring 81 on the applicator tip 24 when the cap 26 fully engages the container 22.

The above exemplary embodiments may be varied to achieve and/or create additional or alternative features. For example, the first and second reservoirs need not be concentrically arranged, but could be parallel to each other, in series, etc. Similarly, the container 22 and/or the reservoirs are not limited to being constructed from the materials, the relative sizes, or the shapes disclosed herein. For example, the container 22 and/or the reservoirs may be constructed from glass, plastic, etc. and may be bottles having various shapes. As a result, the applicator 20 may include plungers, compressed materials, or other devices and/or structures to enable the dispensing of the cosmetic masses. The engaging or closing mechanism for connecting the cap 26 to the container 22 may also vary and need not include threads. For example, the closing mechanism may be a snap type, a lock type, or other mechanism.

The various parts or portions of the applicator 20 may be engaged or connected in different ways, including different steps and/or different sequences, as will be apparent to a person of ordinary skill in the art. Therefore, the manner of assembly described herein is only one of many possible ways to assemble the applicator 20. The inner reservoir 28 may be disposed in the outer reservoir 30, such that the shoulders 42, 56 of the respective reservoirs 28, 30 do not touch, thereby in use allowing space for the flow of the outer cosmetic mass 34. Additionally, the elongate portion 40 may be positioned to extend beyond and through a center of the neck 54 of the outer reservoir 30. The ends of the first and second reservoirs 28, 30 or the container 22 may be crimped and filled with inner and outer cosmetic masses 32, 34, respectively.

The applicator tip 24 may be engaged with the container 22, such that the outer surface 74 of the applicator tip 24 slidingly engages the inner surface 60 of the neck portion 54 until the ring 81 abuts the top 82 of the neck portion 54, and such that the elongate portion 40 is disposed in the shaft 92 of the applicator tip 24. The elongate portion 40 may be inserted into the shaft 92 such that the first section 46 of the elongate portion 40 abuts the first set of ribs 104, and such that the second section 48 of the elongate portion 40 abuts the second set of ribs 102. As a result, the inner and outer reservoirs 28, 30 are oriented relative to each other and the neck 54, and the one or more channels 106 are thus created and defined by the at least one wall of the shaft 92 and the elongate portion 40.

Furthermore, depth wise the elongate portion 40 may be inserted into the shaft 92 until the distal end of the elongate portion 40 abuts the stop members 108 and/or up to a point where the combining area 110 at the distal end of the applicator tip 24 remains. Additionally, the elongate portion 40 must be positioned relative to the applicator tip 24 to ensure that a gap remains between the shoulder 42 of the inner reservoir 28 and the proximal end of the applicator tip 24, to enable the second cosmetic mass 34 to exit the outer reservoir 30 and enter the channels 106. The head 64 of the applicator tip 24 may then be placed on the body 66 by gluing, flocking or other suitable fastening features and processes.

The cap 26 may be caused to engage the container 22 by placing the cap 26 onto the applicator tip 24 or by placing the applicator tip 24 into the cap 26. The applicator 20 may then be closed by engaging the threaded portions of the container 22 and cap 26, and rotating the container 22 and cap 26 relative to each other. The applicator 20 may be considered closed when one or more of several scenarios occur. For example, when the pentel 122 abuts the distal end of the elongate portion 40, when the first ledge 112 abuts the stepped portion 62 on the container 22, and/or when the second ledge 118 abuts a top 82 of the neck 54 of the container 22.

In operation, as seen in FIG. 2, when the applicator 20 is open, i.e., with the cap off, the user may activate the container 22 (e.g., by compression), thereby dispensing the first and second masses 32, 34 from the applicator 20. More specifically, as the user compresses the container 22, the first mass 32 will flow from the first reservoir 28 through the elongate portion 40 and out through the opening 36. At the same time, the second mass 34 will flow past the shoulder 56 of the second reservoir 30, and through the channels 106. The first and second masses 32, 34 will then combine and preferably mix at the opening 36 of the elongate portion 40 and/or or at area 110. The now combined first and second masses 32, 34 being disposed upstream from the outlet will flow toward the outlet 96 of the applicator tip 24 and onto the applicator head 64. When the applicator 20 is closed, i.e. with the cap 26 on the applicator tip 24 (FIG. 3), the first and second masses 32, 34 are prevented from exiting the applicator tip 24. Additionally, the first and second masses 32, 34 are contained to their respective reservoirs, and are prevented from substantially mixing or engaging each other.

The foregoing description is given for clearness of understanding only, and no unnecessary limitations should be understood therefrom, as modifications within the scope of the invention may be apparent to those having ordinary skill in the art.

What is claimed is:

1. A cosmetic applicator for storing and dispensing a plurality of cosmetic masses, comprising:

an applicator container having a first reservoir including an elongate portion and a second reservoir including a neck portion, wherein the first reservoir is disposed within the second reservoir;

an applicator tip having an outer portion that sealingly engages the neck portion and an inner portion having an inlet and an outlet fluidly connected by a shaft having at least one wall, wherein the shaft is fixed relative to the neck portion of the second reservoir and the elongate portion is disposed in the shaft thereby defining a channel between the elongate portion and the at least one wall, the channel being fluidly connected to the second reservoir; and a cap having a plug that engages the outlet of the applicator tip and abuts the elongate portion, thereby sealing the elongate portion and the channel, when the cap is fully engaged on the applicator tip.

2. The cosmetic applicator of claim 1, further including one or more ribs disposed on the at least one wall for aligning the elongate portion.

3. The cosmetic applicator of claim 1, wherein the inner portion of the applicator tip includes one or more protrusions for controlling a depth of engagement of the elongate portion into the shaft.

4. The cosmetic applicator of claim 3, wherein the one or more protrusions are disposed upstream of the outlet of the shaft extending radially inwardly from the at least one wall.

5. The cosmetic applicator of claim 1, further including an application feature disposed on the applicator tip.

6. The cosmetic applicator of claim 5, wherein the application feature comprises flocking.

7. The cosmetic applicator of claim 6, wherein the applicator feature comprises a flocked applicator head.

8. The cosmetic applicator of claim 1, wherein the applicator tip includes a sleeve portion disposed around a body portion, the sleeve portion including the outer portion that engages the neck portion and the body portion including the inner portion.

9. The cosmetic applicator of claim 1, wherein the outer portion includes an outer surface that engages an inner surface of the neck portion.

10. The cosmetic applicator of claim 1, wherein the second reservoir comprises an at least translucent region comprising all or a portion of the reservoir.

11. The cosmetic applicator of claim 10, wherein an at least translucent mass is disposed in the second reservoir.

12. The cosmetic applicator of claim 11, wherein the first reservoir comprises an at least translucent region comprising all or a portion of the reservoir, and further comprises a colored mass disposed in the first reservoir.

13. The cosmetic applicator of claim 10, wherein the at least translucent region comprises a material selected from the group consisting of high density polyethylenes, low density polyethylenes, modified polyolefin adhesives, ethylene vinyl alcohols, and a combination thereof.

14. The cosmetic applicator of claim 1, wherein the cap includes a threaded surface that threadingly engages a counter-threaded surface on the applicator container.

15. The cosmetic applicator of claim 1, wherein at full engagement an interior surface of the cap includes a ledge that abuts a ring disposed on the applicator tip.

16. The cosmetic applicator of claim 1, wherein the plug abuts a first mass fluidly connected to the first reservoir and a second mass fluidly connected to the second reservoir, when the cap is fully engaged on the applicator tip.

17. The cosmetic applicator of claim 1, further including a region in the applicator tip formed in the shaft between an opening of the elongate portion and the outlet for combining masses from the first and second reservoirs.

18. A cosmetic applicator for storing and dispensing a plurality of cosmetic masses, comprising:

an applicator container having a first reservoir including an elongate portion and a second reservoir including a neck portion, the first reservoir being disposed within the second reservoir, wherein the elongate portion is disposed in a shaft thereby defining a channel between the elongate portion and the shaft, the channel being fluidly connected to the second reservoir;

an applicator tip having an outer portion that sealingly engages an inner surface of the neck portion and an inner portion having an inlet and an outlet fluidly connected by the shaft, the shaft including one or more ribs and one or more protrusions extending radially inwardly, wherein the one or more ribs abut an outer surface of the elongate portion thereby aligning the elongate portion relative to the shaft, and wherein the protrusions abut an end of the elongate portion thereby controlling a depth of engagement of the elongate portion into the shaft; and a cap having a plug that abuts the end of the elongate portion and an end of the channel, thereby sealing the elongate portion and the channel, when the cap is fully engaged on the applicator tip.

19. A cosmetic applicator for storing and dispensing a plurality of cosmetic masses, comprising:

an applicator container having a first reservoir including an elongate portion and a second reservoir including a neck portion, wherein the first reservoir is disposed within the second reservoir;

an applicator tip having an outer portion that sealingly engages the neck portion and an inner portion having an inlet and an outlet fluidly connected by a shaft having at least one wall, wherein the elongate portion is disposed in the shaft thereby defining a channel between the elongate portion and the at least one wall, the channel being fluidly connected to the second reservoir; and a cap having a plug that engages the outlet of the applicator tip and abuts the elongate portion, thereby sealing the elongate portion and the channel, when the cap is fully engaged on the applicator tip.

20. The cosmetic applicator of claim 19, wherein the cap includes a threaded surface that threadingly engages a counter-threaded surface on the applicator container.

21. The cosmetic applicator of claim 19, wherein at full engagement an interior surface of the cap includes a ledge that abuts a ring disposed on the applicator tip.

22. The cosmetic applicator of claim 19, wherein the plug abuts a first mass fluidly connected to the first reservoir and a second mass fluidly connected to the second reservoir, when the cap is fully engaged on the applicator tip.

* * * * *